US005580339A

United States Patent [19]

Chen

[11] Patent Number: 5,580,339

[45] Date of Patent: Dec. 3, 1996

[54] ADJUSTABLE HORSE-RIDING EXERCISER

[76] Inventor: Paul Chen, 5th Floor, No. 31, Gan Tzou 2nd Street, Shi Tun Chu, Taichung, Taiwan

[21] Appl. No.: 638,740

[22] Filed: Apr. 29, 1996

[51] Int. Cl.[6] ..... A63B 21/00

[52] U.S. Cl. ..... 482/95; 96/72; 96/57

[58] Field of Search ..... 482/72, 57, 95, 482/51, 96, 111; 472/106, 110, 120

[56] References Cited

U.S. PATENT DOCUMENTS

| | | | |
|---|---|---|---|
| 2,642,288 | 6/1953 | Bell | 482/95 |
| 2,714,507 | 8/1955 | Goodrich | 482/72 |
| 3,904,196 | 9/1975 | Berlin | 482/72 |
| 4,300,760 | 11/1981 | Bobroff | 482/95 |
| 5,254,067 | 10/1993 | Habing et al. | 482/112 |
| 5,478,298 | 12/1995 | Chen | 482/95 |
| 5,527,243 | 6/1996 | Chen | 482/72 |

*Primary Examiner*—Jerome Donnelly
*Attorney, Agent, or Firm*—Charles E. Baxley, Esq.

[57] ABSTRACT

A horse riding simulating exerciser includes a rod for securing a foot support and a seat post pivotally coupled to a middle portion of a frame at a pivot axle and coupled to the rod. A track is secured on the seat post for carrying a slide. A handle is pivotally coupled to the frame and a lever couples the handle to the slide. When the slide is moved to one side of the pivot axle, the seat cushion may be elevated by pulling the handle. When the slide is moved to the other side of the pivot axle, the seat cushion may be elevated by pushing the handle upward.

3 Claims, 3 Drawing Sheets

ADJUSTABLE HORSE-RIDING EXERCISER

BACKGROUND OF THE INVENTION

1. Field of the Invention

The present invention relates to an exerciser, and more particularly to a horse-riding simulating exerciser convertible to both pull type and push type exercises.

2. Description of the Prior Art

Various kinds of horse riding simulating exercisers have been developed. Four prior arts are disclosed in U.S. Pat. No. 5,342,269 to Huang et al. issued Aug. 30, 1994; U.S. Pat. No. 5,356,357 to Wang et al. issued Oct. 18, 1994; U.S. Pat. No. 5,356,358 to Chen issued Oct. 18, 1994; and U.S. Pat. No. 5,366,428 to Liao issued Nov. 22, 1994. However, the typical horse riding type exercisers are pull type exercisers, i.e., the handle bar may be pulled for conducting horse riding type exercises. The exercisers may not be used for conducting push type exercisers.

The applicant have developed several horse riding simulating exercisers that may be changed from a pull type exercise to a push type exercise. U.S. Pat. Nos. 5,429,568 to Chen, and 5,478,298 to Chen are examples of the exercisers.

The present invention has arisen to provide a novel horse riding simulating exercisers.

SUMMARY OF THE INVENTION

The primary objective of the present invention is to provide a convertible horse-riding simulating exerciser which can be used for conducting both pull type and push type horse riding exercises.

In accordance with one aspect of the invention, there is provided a horse riding simulating exerciser comprising a body including a lower portion having a pivot shaft provided therein, including a middle portion having a pivot axle provided therein, and including an upper portion having a pivot pin provided therein, a rod including a front end pivotally coupled to the pivot shaft and including a rear portion having a foot support provided thereon, a seat post including a front portion pivotally coupled to the body at the pivot axle, including a rear portion having a seat cushion provided thereon, and including a front end, the seat post including a track provided thereon, the track including a front portion located in front of the pivot axle and including a rear portion located behind the pivot axle, a slide slidably engaged on the track, means for securing the slide to the track, a link pivotally coupling the front end of the seat post to the rod, a handle including a front end pivotally coupled to the body at the pivot pin, and a lever including a first end pivotally coupled to the handle and including a second end pivotally coupled to the slide. The seat cushion is elevated when the slide is moved and secured to the front portion of the track and when the handle is pulled toward the seat cushion; and the seat cushion is elevated when the slide is secured to the rear portion of the track and when the handle is pushed away from the seat cushion.

The body includes a lateral beam having a rear end and having a stop provided in the rear end, and includes a pole having an upper portion pivotally coupled to the lateral beam at a pivot axis, the pole is rotated in one direction to engage with the stop in order to support the body in a working position and is rotated in a reverse direction to a folded position, the pivot axle is provided in the lateral beam.

The body includes a pair of hand grips provided in the upper portion thereof.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

A horse-riding simulating exerciser in accordance with the present invention may be used for conducting both pull type and push type horse riding exercises. A co-pending U.S. patent application was filed on Apr. 14, 1995 with the application Ser. No. 08/422,246, now allowed. The co-pending U.S. patent application is taken as a reference. The present invention is provided to provide a novel configuration.

Figure 6:
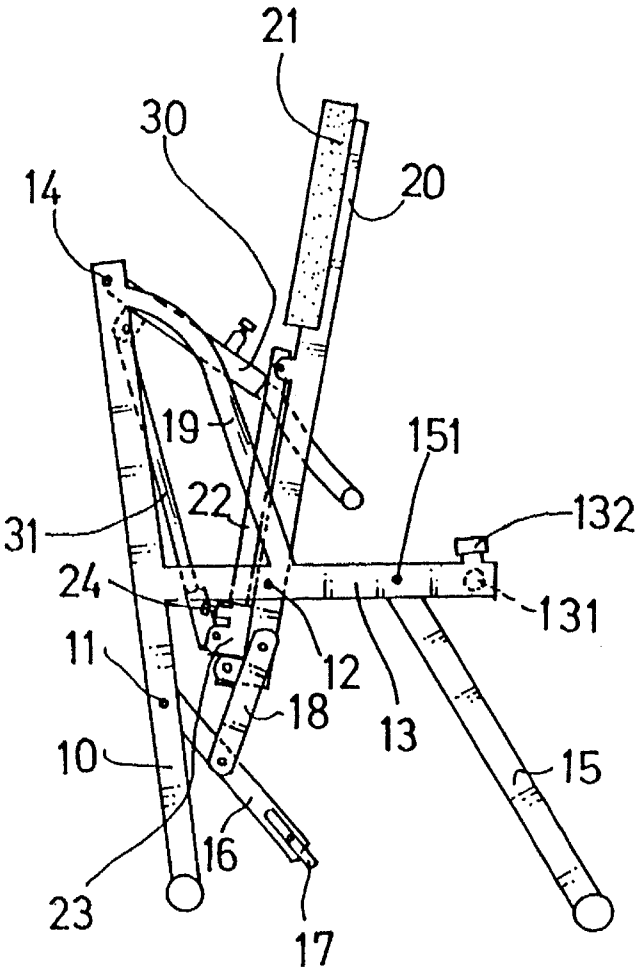
FIGS. 2, 3, 4, 5 and 6 are plane views illustrating the operation of the adjustable horse-riding simulating exerciser.
Figure 1:
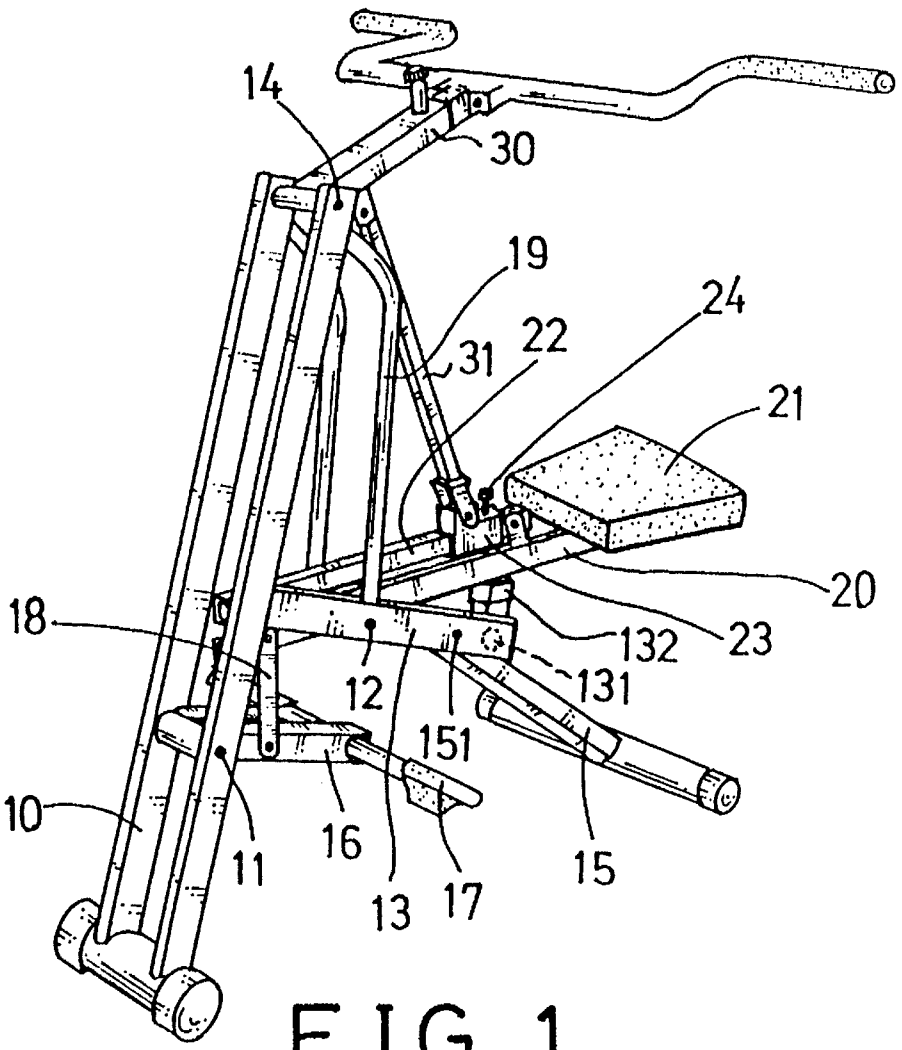
FIG. 1 is a perspective view of a horse-riding simulating exerciser in accordance with the present invention.
Figure 2:
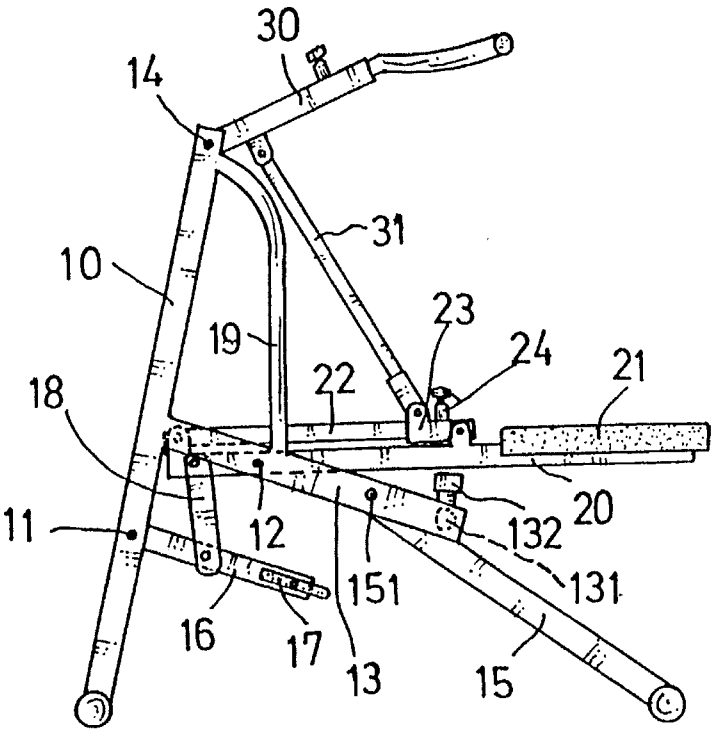

Referring to the drawings, and initially to FIGS. 1 and 2, the exerciser in accordance with the present invention comprises a body 10 including a pivot shaft 11 provided in the lower portion thereof, a pivot axle 12 provided in the middle portion, and a pivot pin 14 provided in the upper portion thereof. The body includes a lateral beam 13 having a stop 131 and a pad 132 provided in the rear end, and includes a pole having an upper portion pivotally coupled to the rear portion of the lateral beam 13 at an axis 151. The pole 15 may be rotated counterclockwise so as to engage with the stop 131 in order to support the body 10 in a working position (FIGS. 2 to 5), and may be rotated clockwise to a folded position (FIG. 6). The pivot axle 12 is provided in the middle portion of the lateral beam 13. A rod 16 includes a front end pivotally coupled to the pivot shaft 11 and includes a rear portion having a foot support 17 provided thereon. The body 10 includes a pair of hand grips 19 provided in the upper portion.

A seat post 20 includes a front portion pivotally coupled to the body 10 at the pivot axle 12 and includes a seat cushion 21 provided on the rear portion thereof. The pad 132 is provided for supporting the seat post 20 in the rest position. The seat post 20 includes a front end pivotally coupled to the rod 16 by a link 18 and includes a track 22 provided thereon. The pivot axle 12 is located corresponding to the middle portion of the track 22 such that the track 22 includes a front end located in front of the pivot axle 12 and includes a rear end located behind the pivot axle 12 (FIGS. 2–5). A slide 23 is slidably engaged on the track 22 and may be secured to the track 22 by a fastening member 24 such as a fastening screw or a fastening pin. A handle 30 includes a front end pivotally coupled to the body 10 at the pivot pin 14. A lever 31 includes an upper end pivotally coupled to the front portion of the handle 30 and includes a lower end pivotally coupled to the slide 23. The handle 30 and the rod 16 may both be rotated to a folded position when the slide 23 is moved to the front end of the track 22, best shown in FIG. 6.

Figure 3:
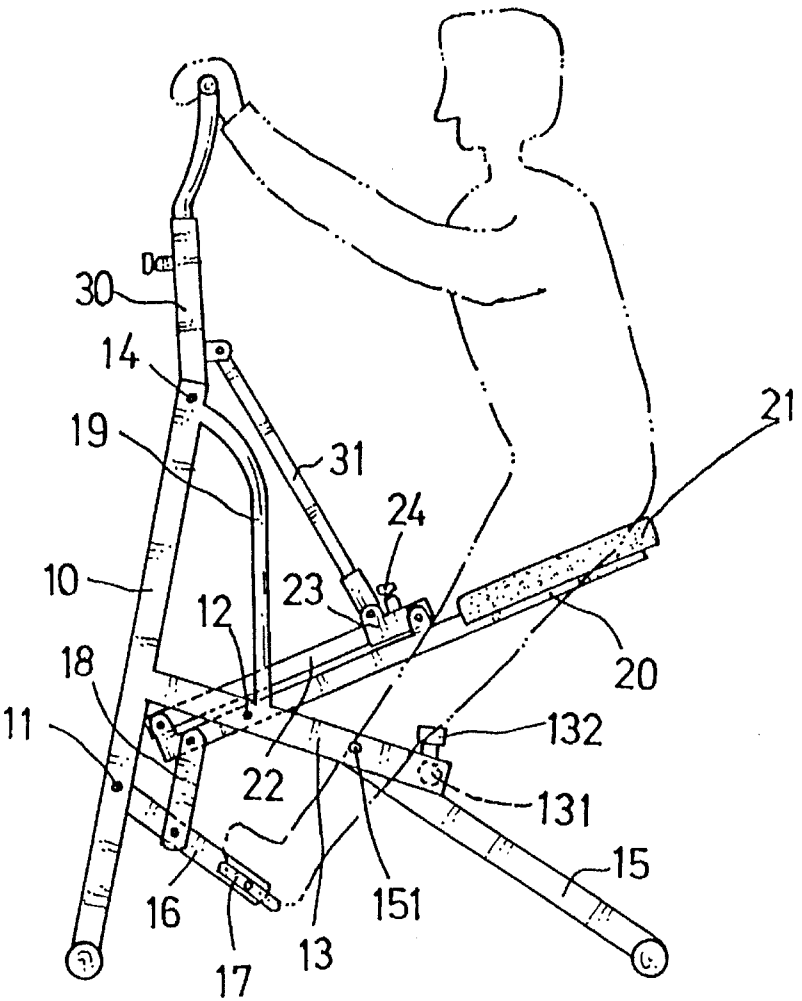
Figure 5:
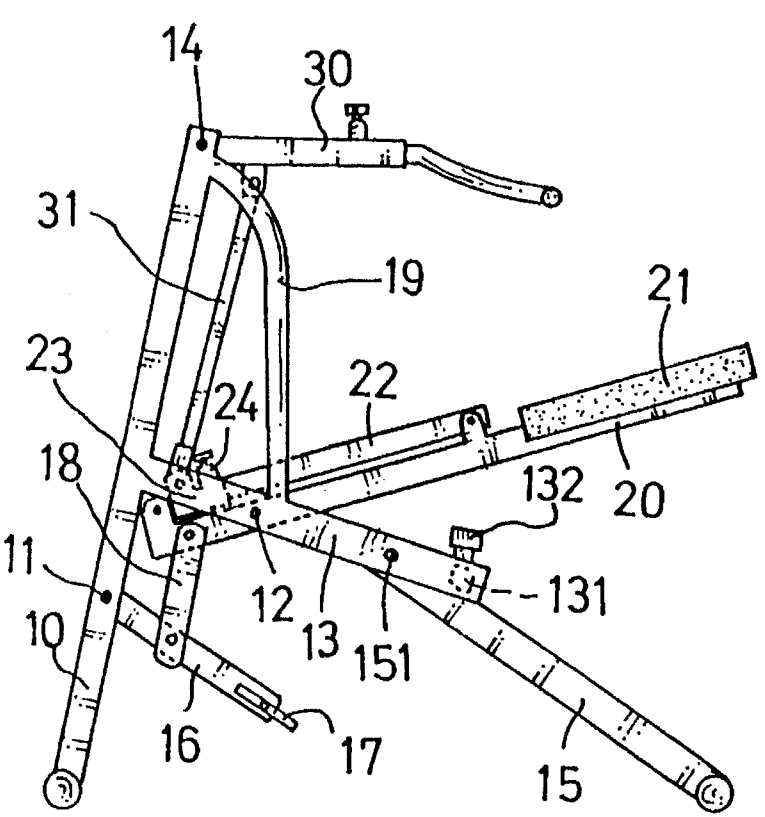
Figure 4:
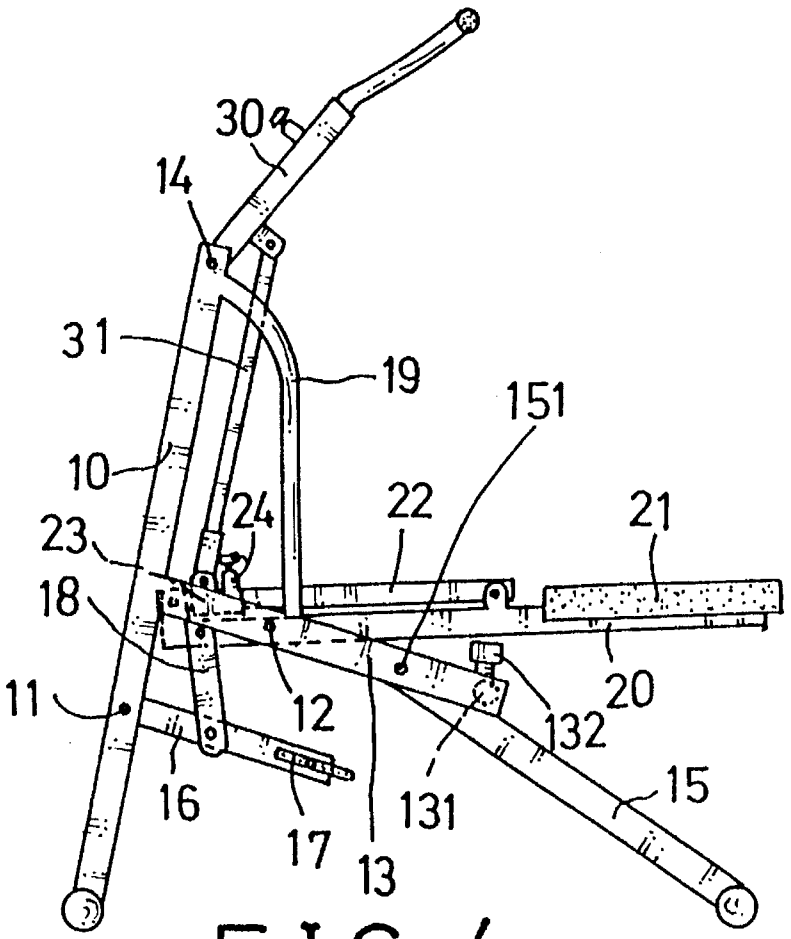

In operation, as shown in FIGS. 2 and 3, when the slide 23 is moved and adjusted along the track 22 to a rear portion of the track 22, i.e., behind the pivot axle 12, the seat cushion 21 may be elevated when the handle 30 is pushed upward or when the foot support is depressed by the users such that the users may conduct push type horse riding simulating exercises. However, as shown in FIGS. 4 and 5, when the slide 23 is moved to the front portion of the track 22, the seat cushion 21 may be elevated when the handle 30 is pulled downward by the users such that the users may conduct pull type horse riding simulating exercises.

It is further to be noted that the slide 23 may be adjusted and secured to any suitable position along the track 22 according to the need of the users or according to the different sizes of the users.

Accordingly, the horse-riding simulating exerciser in accordance with the present invention can be used for conducting both pull type and push type horse riding exercises. In addition, the slide may be adjusted along the track so as to be adjusted according to the user's need.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A horse riding simulating exerciser comprising:

a body including a lower portion having a pivot shaft provided therein, including a middle portion having a pivot axle provided therein, and including an upper portion having a pivot pin provided therein, a rod including a front end pivotally coupled to said pivot shaft and including a rear portion having a foot support provided thereon, a seat post including a front portion pivotally coupled to said body at said pivot axle, including a rear portion having a seat cushion provided thereon, and including a front end, said seat post including a track provided thereon, said track including a front portion located in front of said pivot axle and including a rear portion located behind said pivot axle, a slide slidably engaged on said track, means for securing said slide to said track, a link pivotally coupling said front end of said seat post to said rod, a handle including a front end pivotally coupled to said body at said pivot pin, and a lever including a first end pivotally coupled to said handle and including a second end pivotally coupled to said slide, said seat cushion being elevated when said slide is moved and secured to said front portion of said track and when said handle is pulled toward said seat cushion; and said seat cushion being elevated when said slide is secured to said rear portion of said track and when said handle is pushed away from said seat cushion.

2. An exerciser according to claim 1, wherein said body includes a lateral beam having a rear end and having a stop provided in said rear end, and includes a pole having an upper portion pivotally coupled to said lateral beam at a pivot axis, said pole is rotated in one direction to engage with said stop in order to support said body in a working position and is rotated in a reverse direction to a folded position, said pivot axle is provided in said lateral beam.

3. An exerciser according to claim 1, wherein said body includes a pair of hand grips provided in said upper portion thereof.

* * * * *